US007649543B2

(12) United States Patent
Tanabe

(10) Patent No.: US 7,649,543 B2
(45) Date of Patent: Jan. 19, 2010

(54) IMAGE FORMING DEVICE WITH LED ARRAY HEAD

(75) Inventor: Satoshi Tanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 167 days.

(21) Appl. No.: 11/551,466

(22) Filed: Oct. 20, 2006

(65) Prior Publication Data

US 2007/0115340 A1 May 24, 2007

(30) Foreign Application Priority Data

Nov. 22, 2005 (JP) ..... 2005-337471

(51) Int. Cl.
*B41J 15/14* (2006.01)
*B41J 27/00* (2006.01)

(52) U.S. Cl. ..... 347/242; 347/257

(58) Field of Classification Search ..... 347/241, 347/242, 245, 256, 257, 263; 399/113, 167, 399/25, 111, 114
See application file for complete search history.

(56) References Cited

U.S. PATENT DOCUMENTS 5,089,846 A * 2/1992 Tabuchi ..... 399/167
5,291,249 A * 3/1994 Lee ..... 399/113
6,714,750 B2 * 3/2004 Terada et al. ..... 399/111

FOREIGN PATENT DOCUMENTS

| | | | |
|---|---|---|---|
| JP | 05249767 A | * | 9/1993 |
| JP | H5 249767 | | 9/1993 |
| JP | 2003 255805 | | 9/2003 |
| JP | 2004 167728 | | 6/2004 |
| JP | 2005 140944 | | 6/2005 |

* cited by examiner

*Primary Examiner*—Hai C Pham
(74) *Attorney, Agent, or Firm*—Baker Botts, LLP

(57) ABSTRACT

A head moving mechanism includes a head connecting member, a contact member, and a linking mechanism. An LED array head is attached to the head connecting member. The contact member is movable in the vertical direction, and the linking mechanism moves the head connecting member in the vertical direction in association with the vertical movement of the contact member. When a process cartridge is mounted to a main casing, the contact member contacts the process cartridge and moves upward. This moves the LED array head toward a photosensitive drum. On the other hand, when the process cartridge is pulled out from the main casing, the contact member moves downward, moving the LED array head away from the photosensitive drum.

3 Claims, 5 Drawing Sheets

IMAGE FORMING DEVICE WITH LED ARRAY HEAD

CROSS REFERENCE TO RELATED APPLICATION

This application claims priority from Japanese Patent Application No. 2005-337471 filed Nov. 22, 2005. The entire content of this priority application is incorporated herein by reference.

TECHNICAL FIELD

The disclosure relates to an image forming device such as an electrophotographic printer.

BACKGROUND

In image forming devices, such as electrophotographic printers, an electrostatic latent image is formed on a uniformly-charged surface of a photosensitive drum by exposing the surface by light from an exposure unit. When a developer is supplied onto the electrostatic latent image, a developer image is carried on the surface of the photosensitive drum. The developer image is then transferred onto a sheet of paper. In this manner, an image is formed on a sheet of paper.

In some of the image forming devices, an LED (light-emitting diode) array head is provided as the exposure unit, and a process cartridge having the photosensitive drum is detachably mounted to a device main body. The LED array head has a plurality of LEDs arranged in an axial direction of the photosensitive drum, and is disposed in close vicinity to and in opposition to the surface of the photosensitive drum. The LED array head irradiates light from each LED, without going through a reflecting mirror, on the surface of the photosensitive drum. Because the LED array head is in close vicinity to the surface of the photosensitive drum, the LED array head forms an obstacle to attachment or detachment of the process cartridge. Thus, in the image forming device with such configuration, a mechanism for moving the LED array head toward or away from the surface of the photosensitive drum is essential.

Japanese Patent-Application Publication No. 2004-167728 proposes to attach an LED head to an inner surface of a cover that opens or closes an upper surface of a main casing so that the LED head is moved toward or away from a surface of a photosensitive drum in association with the closing and opening of the cover.

However, in this configuration, it is necessary to ensure a large space for opening the cover above the main casing. Thus, such an image forming device is unsuitable for installation on a location, such as on a shelf, having a limited space in the vertical direction.

In an image forming device proposed by Japanese Patent-Application Publication No. HEI-5-249767, an outer cover is provided on a front surface of a main casing, and an LED array head is attached to a holder that rotates in association with the opening or closing of the outer cover, moving the LED array head toward or away from a surface of a photosensitive member This configuration does not require a large space above the image forming device since the outer cover is provided on the front surface of the main casing. However, this configuration requires the holder to be long in the vertical direction. This configuration also requires a mechanism for linking opening or closing of the outer cover to the rotation of the holder Thus, the dimension of the image forming device especially in the vertical direction cannot be reduced. For his reason, the image forming device proposed in Japanese Patent-Application Publication No. HEI-5-249767 also is unsuitable for installation on a location with a limited space in the vertical direction.

SUMMARY

In view of the foregoing, it is an object of the invention to provide an image forming device that is capable of moving an LED array head toward or away from an image bearing member and that is suitable for installation on a place with a limited space in the vertical direction.

In order to attain the above and other objects, the invention provides an image forming device including: a main casing having an upper side and a first side other than the upper side, the main casing being formed with an opening in the first side; a process cartridge including an image bearing member, the process cartridge being detachably attachable to the main casing through the opening; a cover provided to the first side of the main casing, the cover being selectively opened and closed; an LED array head disposed in the main casing, the LED array head irradiating a light on the image bearing member; and a head moving mechanism that moves the LED array head toward or away from the image bearing member as the process cartridge is attached to or detached from the main casing.

BRIEF DESCRIPTION OF THE DRAWINGS

Illustrative aspects in accordance with the invention will be described in detail with reference to the following figures wherein.

DETAILED DESCRIPTION

Figure 1:
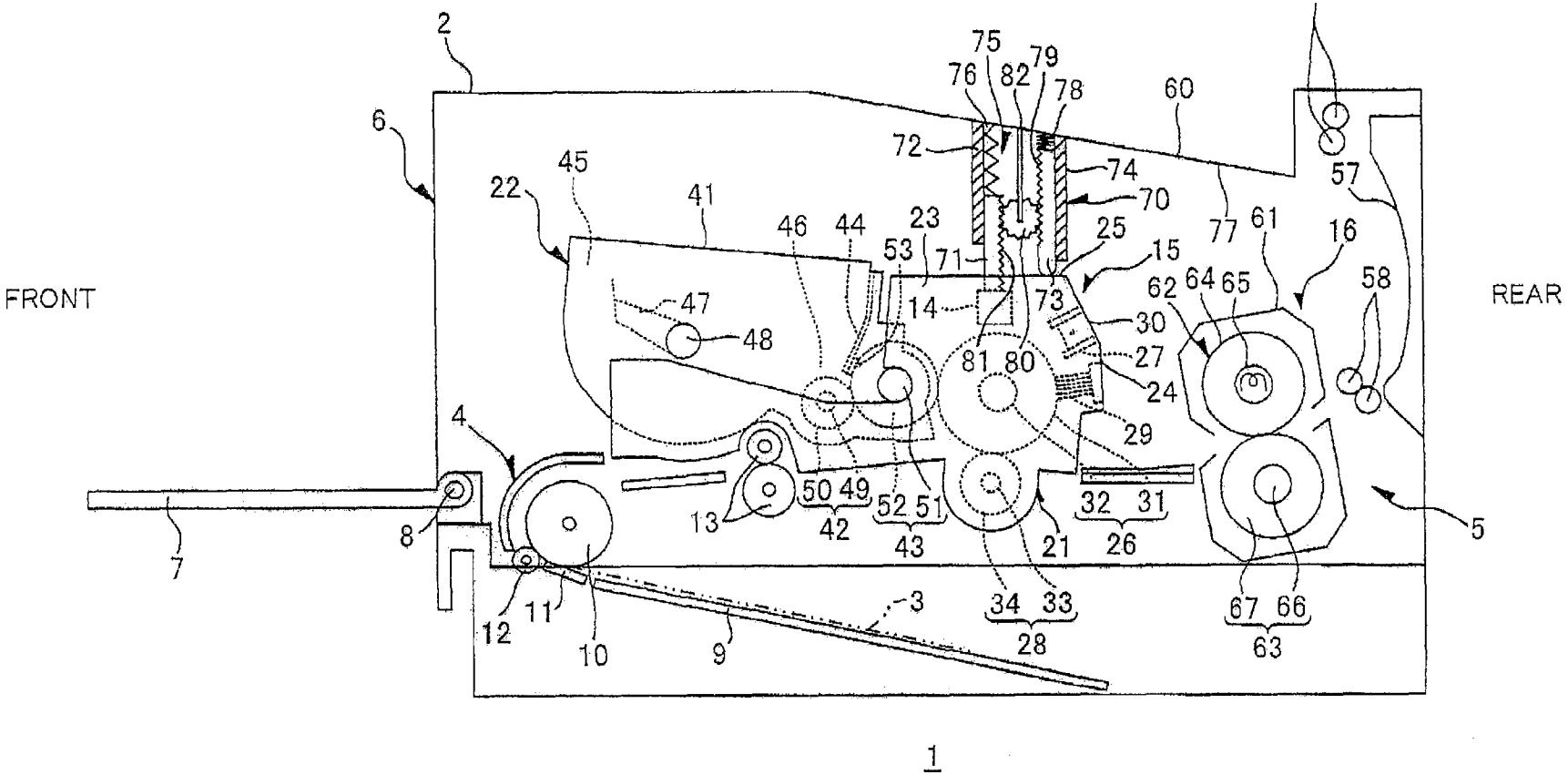
FIG. 1 is a cross sectional view of an LED printer according to a first illustrative aspect of the invention.

Image forming devices according to some aspects of the invention will be described while referring to the accompanying drawings wherein like parts and components are designated by the same reference numerals to avoid duplicating description.

First, an LED printer 1 as an image forming device according to a first illustrative aspect of the invention will be described with reference to FIGS. 1 to 4.

Note that in the following description, the expressions "front", "rear", "left", "right", "above", and "below" are used to define the various parts when the LED printer 1 is disposed in an orientation in which it is intended to be used. As shown in FIG. 1, the LED printer 1 includes a main casing 2, and within the main casing 2, a feeder unit 4 for supplying sheets of a paper 3 and an image-forming unit 5 for forming images on the paper 3 supplied from the feeder unit 4.

The main casing 2 has a larger dimension in a front-to-rear direction than in the vertical direction. An access opening 6 is formed in a front side of the main casing 2. A process cartridge 15 to be described later is mounted to and dismounted from the main casing 2 through the access opening 6. A front cover 7 is disposed on the main casing 2 for opening and closing the access opening 6.

The front cover 7 is pivotably supported by a cover shaft 8 that is inserted through a bottom end of the front cover 7. When the front cover 7 is pivoted to close about the cover shaft 8, the front cover 7 becomes flush with the front surface of the main casing 2, thereby closing the access opening 6. On the other hand, when the front cover 7 is pivoted to close about the cover shaft 8 such that the front cover 7 slants toward the front, the access opening 6 is exposed, allowing the process cartridge 15 to be mounted to and dismounted from the main casing 2.

The feeder unit 4 includes a paper tray 9 disposed in a lower section of the main casing 2, a feeding roller 10 and a separating pad 11 disposed above a front end of the paper tray 9, a paper-dust removing roller 12 disposed below a front end of the feeding roller 10, and a pair of upper and lower registration rollers 13 disposed rearward of the feeding roller 10.

The paper tray 9 is capable of supporting a stack of sheets of paper 3. The separating pad 11 contacts the feeding roller 10 from the bottom and is urged toward the feeding roller 10 by a spring (not shown) disposed below the separating pad 11.

The topmost sheet of the paper 3 stacked on the paper tray 9 is pressed against the feeding roller 10. When the sheets of paper 3 are nipped between the feeding roller 10 and the separating pad 11 due to the rotation of the feeding roller 10, the sheets of paper 3 are separated and fed one sheet at a time. Afterwards, the paper-dust removing roller 12 removes paper dusts from the fed paper 3. Then, the conveying direction of the paper 3 is turned to the rearward direction, and the paper 3 is conveyed toward the registration rollers 13.

After adjusting the registration of the paper 3, the registration rollers 13 convey the sheet of paper 3 to a transfer position in the image-forming unit 5 (a position between a photosensitive drum 26 and a transfer roller 28 described later at which a toner image formed on the photosensitive drum 26 is transferred onto the paper 3).

The image-forming unit 5 includes an LED array head 14, the process cartridge 15, and a fixing unit 16.

The LED array head 14 includes LEDs (not shown) that are arranged in the axial direction of the photosensitive drum 26 (widthwise direction of the LED printer 1). The number of the LEDs depends on resolution of the LED printer 1. The LED array head 14 is movable toward or away from the photosensitive drum 26 in association with the attachment or detachment of the process cartridge 15 to or from the main casing 2. In the state where the process cartridge 15 is mounted on the main casing 2, the LED array head 14 is disposed above and in close vicinity to the surface of the photosensitive drum 26 so as to be opposed to the same, and light from each of the LEDs can be focused with a predetermined beam diameter on the surface of the photosensitive drum 26.

The process cartridge 15 is detachably mounted to the main casing 2. The process cartridge 15 includes a drum cartridge 21 and a developer cartridge 22 that is detachably mounted onto the drum cartridge 21. The developer cartridge 22 can be mounted to or removed from the main casing 2 while being mounted on the drum cartridge 21. The developer cartridge 22 can also be mounted to or removed from the main casing 2 while the drum cartridge 21 remains mounted on the main casing 2.

Figure 2:
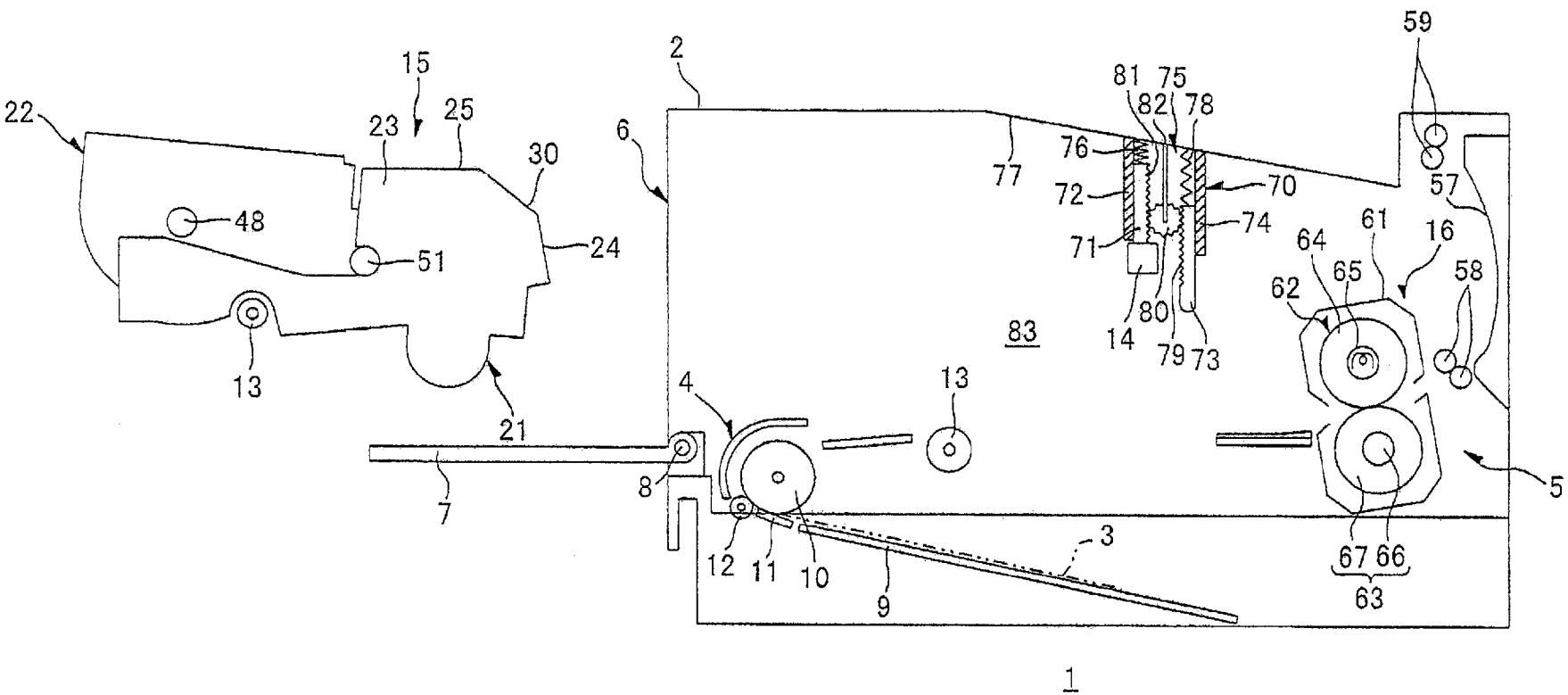
FIG. 2 is a cross sectional view of the LED printer in FIG. 1 with a process cartridge being detached from a main casing.
Figure 3:
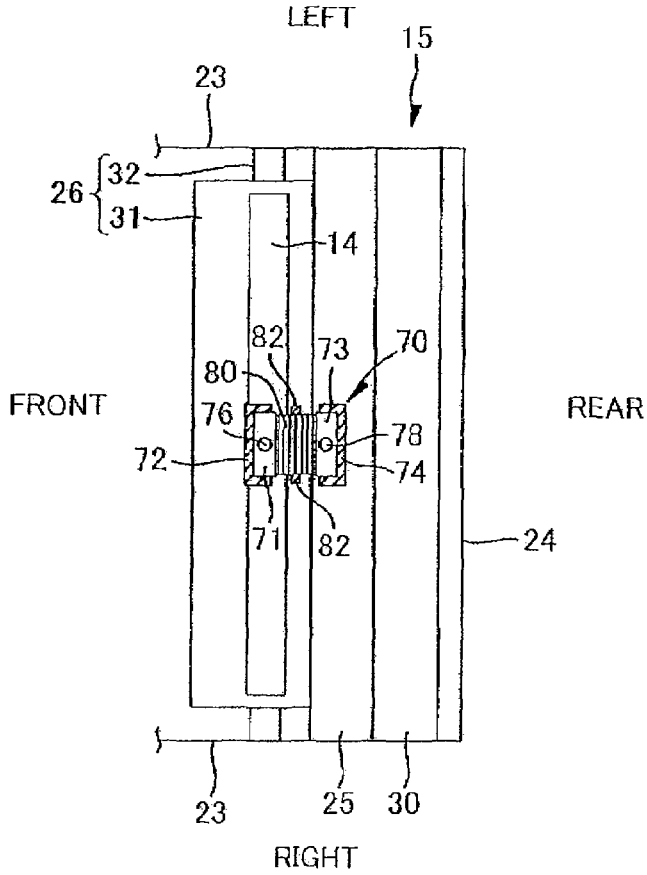
FIG. 3 is a plan view of a rear section of the process cartridge of the LED printer in FIG. 1.

As shown in FIGS. 2 and 3, the drum cartridge 21 includes a pair of side plates 23, a rear plate 24, and an upper plate 25. The side plates 23 extends in the front-to-rear direction and opposes each other in the widthwise direction. The rear plate 24 extends between rear edges of the side plates 23 and has an inclined surface 30 at the upper section. The inclined surface 30 inclines upward toward the front for guiding a contact member 73 described later during attachment or detachment of the process cartridge 15.

The upper plate 25 extends from an upper end of the rear plate 24 toward the front. As shown in FIG. 3, the upper plate 25 has a length in the front-to-rear direction to cover a part of the photosensitive drum 26 and to expose the remaining part of the photosensitive drum 26 as viewed from the above.

The developer cartridge 22 is disposed between the side plates 23. As shown in FIG. 1, disposed between the side plates 23 and rearward of the developer cartridge 22 are the photosensitive drum 26, a Scorotron charger 27, the transfer roller 28, and a cleaning brush 29.

The photosensitive drum 26 includes a main drum body 31 that is cylindrical in shape and has a positive charging photosensitive layer formed of polycarbonate on its outer surface, and a metal drum shaft 32 extending through the axial center of the main drum body 31. The drum shaft 32 is unrotatably supported on the side plates 23, and the main drum body 31 is rotatably supported on the drum shaft 32. With this construction, the photosensitive drum 26 is disposed between the side plates 23 so as to be rotatable about the drum shaft 32.

The charger 27 is supported by the upper end of the rear plate 24 and is disposed to the rear of and diagonally above the photosensitive drum 26. The charger 27 is disposed in confrontation with the photosensitive drum 26 but is spaced away from the photosensitive drum 26 by a minute distance. The charger 27 generates a corona discharge from a discharge wire so as to charge the surface of the photosensitive drum 26 with a uniform positive polarity. The charger 27 has a grid for controlling the discharge wire and the amount of discharge from the discharge wire.

The transfer roller 28 is freely rotatably supported on the side plates 23 of the drum cartridge 21 and contacts the photosensitive drum 26 from the bottom. The transfer roller 28 is configured of a metal roller shaft 33 that is covered with a rubber roller 34 formed of an electrically conductive foam material. During a transfer operation, a transfer bias is applied to the transfer roller 28.

The cleaning brush 29 is supported on the lower section of the rear plate 24 and is disposed rearward of the photosensitive drum 26 such that a tip end of the cleaning brush 29 contacts the surface of the main drum body 31 of the photosensitive drum 26.

The developer cartridge 22 includes a box-shaped casing 41 that is open on the rear side. The developer cartridge 22 also includes, within the casing 41, a supply roller 42, a developing roller 43, and a thickness-regulating blade 44. The interior of the casing 41 is divided into a toner chamber 45 on the front side and a developing chamber 46 on the rear side. The toner chamber 45 is filled with a nonmagnetic, single-component toner having a positive charge. The toner used is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation. This type of toner is compounded with a coloring agent, such as carbon black, or wax, as well as an additive such as silica to improve fluidity.

An agitator 47 is disposed inside the toner chamber 45 for agitating the toner within the toner chamber 45. The agitator 47 is supported on an agitator shaft 48 that is disposed in the center of the toner chamber 45 to extend in the widthwise direction. The agitator 47 rotates about the agitator shaft 48, thereby agitating the toner inside the toner chamber 45 and also discharging the toner from the toner chamber 45 toward the developing chamber 46.

The supply roller 42 is disposed inside the developing chamber 46 and is rotatably supported on right and left side plates of the casing 41 opposing each other in the widthwise direction. The supply roller 42 is configured of a metal roller shaft 49 extending in the widthwise direction and a sponge roller 50 that covers the roller shaft 49. The sponge roller 50 is formed of an electrically conductive foam material.

The developing roller 43 is disposed in the developing chamber 46 and is rotatably supported between the left and right side plates of the casing 41. The developing roller 43 is disposed so that a part of the surface of the developing roller 43 protrudes rearward from the casing 41 to be exposed. In the state where the developing cartridge 22 is attached to the drum cartridge 21, the exposed part of the developing roller 43 is in contact with the photosensitive drum 26.

The developing roller 43 is configured of a metal roller shaft 51 that is covered with a rubber roller 52 formed of an electrically conductive rubber material. The rubber roller 52 is more specifically formed of an electrically conductive urethane rubber or silicon rubber containing fine carbon particles or the like, the surface of which is coated with urethane rubber or silicon rubber containing fluorine.

The rubber roller 52 contacts the sponge roller 50 of the supply roller 42 with pressure so that both are compressed. During image forming operations, a developing bias is applied to the developing roller 43.

The thickness-regulating blade 44 is configured of a metal leaf spring member, and a pressing part 53 is provided on a distal end of the thickness-regulating blade 44. The pressing part 53 has a semicircular cross section and is formed of an insulating silicon rubber. The thickness-regulating blade 44 is supported on the casing 41 above the developing roller 43 so that an lower end of the thickness-regulating blade 44 confronts the rubber roller 52 of the developing roller 43, and the elastic force of the thickness-regulating blade 44 causes the pressing part 53 to contact the surface of the rubber roller 52 with pressure.

Toner within the developing chamber 46 is supplied onto the developing roller 43 (robber roller 52) by the rotation of the supply roller 42. At this time, the toner is positively tribocharged between the supply roller 42 (sponge roller 50) and the developing roller 43. As the developing roller 43 rotates, the toner supplied to the surface of the developing roller 43 passes between the pressing part 53 of the thickness-regulating blade 44 and the developing roller 43, thereby maintaining a thin layer of uniform thickness on the surface of the developing roller 43.

Meanwhile, the charger 27 charges the surface of the photosensitive drum 26 with a uniform positive polarity. Subsequently, a laser beam emitted from the LED array head 14 is scanned over the surface of the photosensitive drum 26, forming an electrostatic latent image based on image data.

Next, positively charged toner carried on the surface of the developing roller 43 comes into contact with the photosensitive drum 26 as the developing roller 43 rotates and is supplied to the electrostatic latent image, that is, areas on the surface of the positively charged photosensitive drum 26 that were exposed to the laser beam and, therefore, have a lower potential. In this way, the electrostatic latent image on the photosensitive drum 26 is transformed into a visible image according to a reverse development process so that a toner image is carried on the surface of the photosensitive drum 26.

As the registration rollers 13 convey a sheet of the paper 3 through the transfer position between the photosensitive drum 26 and the transfer roller 28, the toner image carried on the surface of the photosensitive drum 26 is transferred onto the paper 3 by the transfer bias applied to the transfer roller 28. After the toner image is transferred, the paper 3 is conveyed to the fixing unit 16.

Note that paper dust that is deposited on the surface of the photosensitive drum 26 is removed by the cleaning brush 29 when the surface of the photosensitive drum 26 is brought into confrontation with the cleaning brush 29.

The fixing unit 16 is disposed to the rear of the process cartridge 15. The fixing unit 16 includes a frame 61 that extends in the widthwise direction, a heat roller 62, and a pressure roller 63. The heat roller 62 and the pressure roller 63 are rotatably supported on the frame 61 and are in confrontation with each other in the vertical direction.

The heat roller 62 has a metal tube 64 and a halogen lamp 65 disposed within the metal tube 64 for generating heat. The heat roller 62 is driven to rotate by a driving force from a motor (not shown).

The pressure roller 63 is disposed below the heat roller 62 and presses the heat roller 62 from the bottom. The pressure roller 63 is configured of a metal roller shaft 66 covered with a rubber roller 67. The pressure roller 63 follows the rotational drive of the heat roller 62.

In the fixing unit 16, a toner image transferred onto the paper 3 is thermally fixed to the paper 3 as the paper 3 passes between the heat roller 62 and the pressure roller 63.

After the toner image is fixed to the paper 3, the paper 3 is conveyed to a discharge path 57 extending in the vertical direction upward toward the top surface of the main casing 2. Then, the paper 3 is conveyed along the discharge path 57 by convey rollers 58, and is discharged on to a discharge tray 60 formed on the top surface of the main casing 2 by discharge rollers 59 disposed at the upper end of the discharge path 57.

Figure 4:
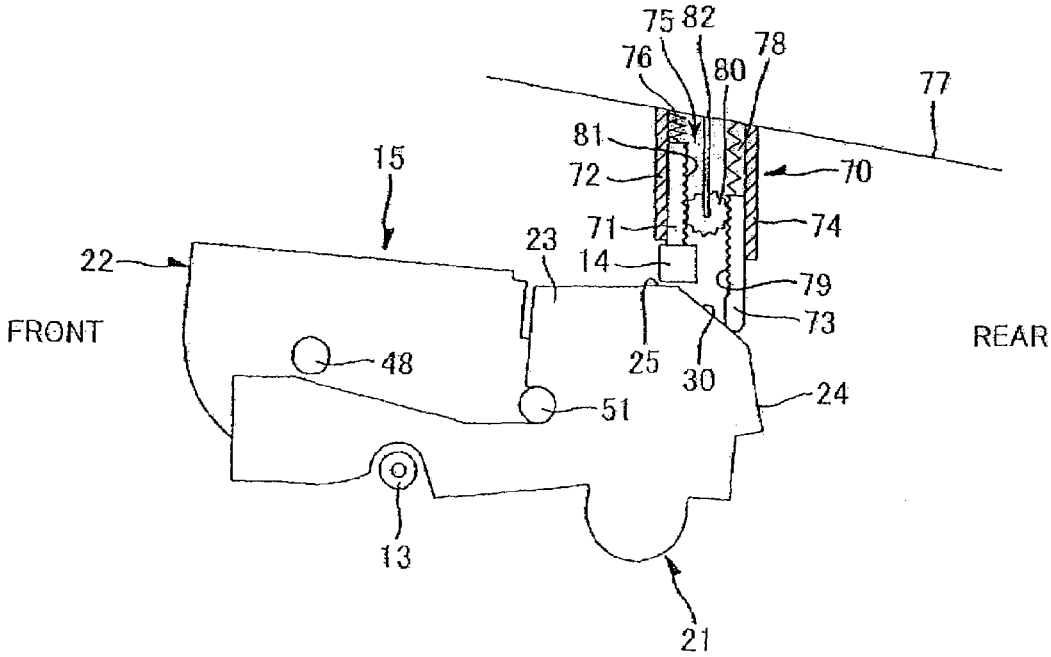
FIG. 4 is a side sectional view of the process cartridge that is being attached to or detached from the main casing.

As shown in FIGS. 3 and 4, the LED printer 1 further includes a head moving mechanism 70 for moving the LED array head 14 toward or away from the photosensitive drum 26 in association with the attachment or detachment of the process cartridge 15 to or from the main casing 2.

The head moving mechanism 70 has a head connecting member 71, a guide member 72, a contact member 73, a guide member 74, and a linking mechanism 75.

The head connecting member 71 is shaped like a vertically long square pole and is movable in the vertical direction. The LED array head 14 is attached to the lower end of the head connecting member 71. A spring 76 is connected to the upper end of the head connecting member 71 and to a lower surface of an upper wall 77 of the main casing 2 such that the head connecting member 71 is hang from the upper wall 77 via the spring 76. The spring 76 has an elastic force to push the head connecting member 71 upward, so that the head connecting member 71 is urged upward due to the elastic force of the spring 76.

The guide member 72 is formed to be vertically long and has a substantially C-shaped cross section that is open on the rear side when cut along a horizontal plane. The guide member 72 is engaged with the head connecting member 71, and the upper end of the guide member 72 is fixed to the lower surface of the upper wall 77.

The contact member 73 is shaped like a vertically long square pole and is disposed to the rear of the head connecting member 71 so as to be movable in the vertical direction. A spring 78 is connected to the upper end of the contact member 73 and to the lower surface of the upper wall 77 such that the contact member 73 is hang from the lower surface of the upper wall 77 via the spring 78. The spring 78 has an elastic force to push the contact member 73 downward so that the contact member 73 is urged downward due to the elastic force of the spring 78 and gravity. The contact member 73 has a rounded lower end with substantially circular arc cross section.

The guide member 74 is formed to be vertically long and has a substantially C-shaped cross section that is open on the front side when cut along the horizontal plane. The guide member 74 is engaged with the contact member 73. The upper end of the guide member 74 is fixed to the lower surface of the upper wall 77.

The linking mechanism 75 is for moving the head connecting member 71 in the vertical direction in association with the vertical movement of the contact member 73. The linking mechanism 75 has a contact-member-side rack gear 79, a pinion gear 80, and a head-side rack gear 81. The contact-member-side rack gear 79 is formed on a surface of the contact member 73 that opposes the head connecting member 71. The pinion gear 80 is engaged with the contact-member-side rack gear 79. The head-side rack gear 81 is formed on a surface of the head connecting member 71 that opposes the contact member 73. The head-side rack gear 81 is engaged with the pinion gear 80.

The pinion gear 80 is supported at lower ends of a pair of pinion gear supporting arms 82 hanging from the lower surface of the upper wall 77 so as to be rotatable about a rotational axis extending in the widthwise direction.

With this configuration, when a force is applied to the contact member 73 to press the same upward, the contact member 73 moves upward against the elastic forces of the springs 76, 78 and gravity, and the pinion gear 80 rotates in the counterclockwise direction in FIG. 4. In association with this, the head connecting member 71 moves downward. When the force applied to the contact member 73 is released, the contact member 73 moves downward due to the elastic force of the spring 78 and gravity, and the pinion gear 80 rotates in the clockwise direction in FIG. 4. As a result, the head connecting member 71 moves upward. At this time, the elastic force of the spring 76 helps the movement of the head connecting member 71.

The movement of the LED array head 14 in association with the attachment or detachment of the process cartridge 15 will be described.

As shown in FIG. 2, in the state where the process cartridge 15 is detached from the main casing 2, the contact member 73 is at a lowest position on an attachment/detachment path 83 of the process cartridge 15, and the LED array head 14 is greatly retreated above the attachment/detachment path 83.

When the process cartridge 15 is inserted into the main casing 2 through the access opening 6 and is moved rearward toward an attachment position (the position of the process cartridge 15 shown in FIG. 1) along the attachment/detachment path 83, as shown in FIG. 4, the inclined surface 30 of the process cartridge 15 (drum cartridge 21) comes into abutment with the lower end of the contact member 73 on the attachment/detachment path 83 When process cartridge 15 is further moved rearward, the lower end of the contact member 73 slides over the inclined surface 30 to the upper front of the process cartridge 15 so that the contact member 73 moves upward against the elastic forces of the springs 76, 78 and gravity, moving the head connecting member 71 downward.

When the process cartridge 15 has reached the attachment position as shown in FIG. 1, the lower end of the contact member 73 comes into contact with the upper surface of the upper plate 25, and thus the movement of the contact member 73 and the head connecting member 71 is stopped. As a result, the LED array head 14 is held above and in close vicinity of the surface of the photosensitive drum 26 so as to be opposed to the photosensitive drum 26.

On the other hand, when the process cartridge 15 is moved forward from the state shown in FIG. 1, the lower end of the contact member 73 slides over the inclined surface 30 toward the lower rear side of the process cartridge 15, moving the contact member 73 due to the elastic force of the spring 78 and gravity. Thus, the head connecting member 71 moves upward. When the process cartridge 15 is separated from the contact member 73, the contact member 73 reaches the lowest position on the attachment/detachment path 83, and the LED array head 14 is greatly retreated above the attachment/detachment path 83 as shown in FIG. 2 As described above, since the front cover 7 is provided in the front side of the main casing 2, it is unnecessary to secure a large space above the LED printer 1 for enabling attachment or detachment of the process cartridge 15. Also, since the LED array head 14 moves in association with the attachment or detachment of the process cartridge 15, it is unnecessary to provide a mechanism for linking opening or closing of the front cover 7 with the movement of the LED array head 14, thereby enabling the LED printer 1 to be formed more compact. Thus, while enabling the LED array head 14 to move toward or away from the photosensitive drum 26, the LED printer 1 can be in installed at a place with a limited space in the vertical direction.

Since the main casing 2 has a relatively long length in the front-to-rear direction, the vertical dimension of the LED printer 1 can be small. Although the photosensitive drum 26 is disposed at the rear section of the process cartridge 15, that is a leading section of the process cartridge 15 in the inserting direction in which the process cartridge 15 is inserted into the main casing 2, the LED array head 14 moves in association with the attachment or detachment of the process cartridge 15. Thus, it is unnecessary to provide a mechanism for linking opening or closing of the front cover 7 to the movement of the LED array head 14. Because it is unnecessary to provide such a mechanism below the process cartridge 15, the LED printer 1 can be further reduced in size in the vertical direction.

Next, an LED printer according to a second illustrative aspect will be described with reference to FIGS. 5 and 6. The following description focuses on points of the construction according to the second illustrative aspects that differ from the construction according to the above aspect.

Figure 5:
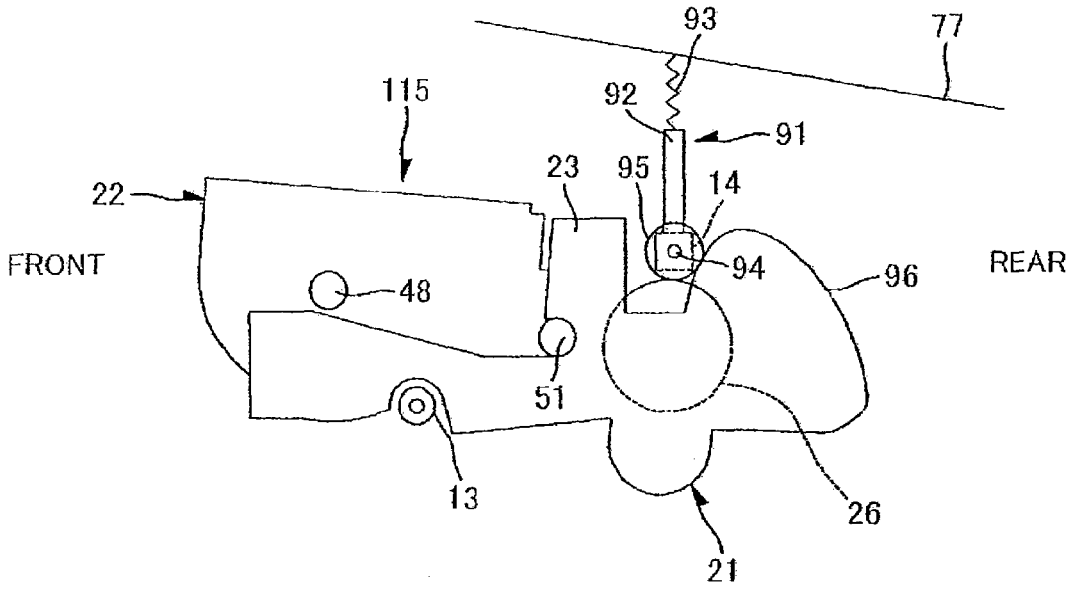
FIG. 5 is a side view illustrating a head moving mechanism according to a second illustrative aspect of the invention where an LED array head is located close vicinity to a photosensitive drum.
Figure 6:
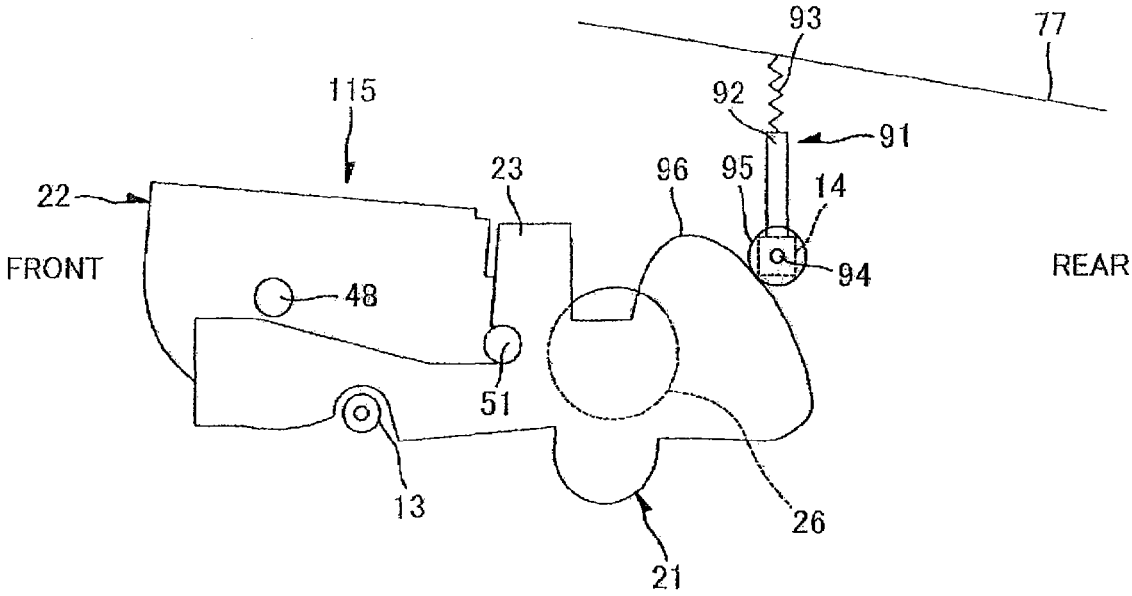
FIG. 6 is a side view illustrating the head moving mechanism in FIG. 5 where the LED array head is separated away from the photosensitive drum.

The LED printer according to the second illustrative aspect includes a head moving mechanism 91 shown in FIGS. 5 and 6. The head moving mechanism 91 has a head holder 92, a head supporting spring 93, a rotating shaft 94, and a pair of columns 95. The LED array head 14 is attached to the lower end of the head holder 92. The head supporting spring 93 is disposed between the upper end of the head holder 92 and the lower surface of the upper wall 77 of the main casing 2. The head supporting spring 93 elastically supports the head holder 92. The rotating shaft 94 extends in the widthwise direction.

The columns 95 are disposed on 5 both sides of the LED array head 14 in the widthwise direction and rotatably attached to the rotating shaft 94 such that the columns 95 can move in the vertical direction along with the head holder 92 and the LED array head 14.

A process cartridge 115 has a guide surface 96 between the rear ends of the side plates 23. The guide surface 96 is gently curved and protruding upward. More specifically, when viewed from the side, the guide surface 96 extends from the rear lower ends of the side plates 23 to the upper rear side while gently curving, bends in a curved fashion in the rear of the photosensitive drum 26, and extends to the lower front side.

In the state where the process cartridge 115 is detached from the main casing 2, the LED array head 14 is located on the attachment/detachment path 83. When the process cartridge 115 is moved rearward toward the attachment position along the attachment/detachment path 83, the rear portion of the guide surface 96 of the process cartridge 115 comes into contact with the columns 95 as shown in FIG. 6.

When the process cartridge 115 is further moved rearward, the columns 95 roll over the rear portion of the guide surface 96 and pressed upward. As a result, the LED array head 14 and the head holder 92 move upward against an elastic force of the head supporting spring 93 and gravity.

When the process cartridge 115 is further moved rearward, the columns 95 pass the top of the guide surface 96, and the columns 95 roll over the front portion of the guide surface 96 downward. Thus, the LED array head 14 and the head holder 92 move downward. When the process cartridge 115 has reached the attachment position as shown in FIG. 5, the columns 95 come into contact with the both ends of the photosensitive drum 26, and the LED array head 14 is disposed in close vicinity of the photosensitive drum 26 with a certain distance therebetween so as to be opposed to the photosensitive drum 26.

On the other hand, when the process cartridge 115 is pulled forward from the state shown in FIG. 5, the columns 95 roll over the front portion of the guide surface 96 upward. Thus, the LED array head 14 and the head holder 92 move upward against the elastic force of the head supporting spring 93 and gravity, and the LED array head 14 moves away from the photosensitive drum 26. When the process cartridge 115 is further moved forward, the columns 95 pass the top of the guide surface 96 and roll over the rear portion of the guide surface 96 downward as shown in FIG. 6. Thus, the LED array head 14 and the head holder 92 move downward. Then, the guide surface 96 separates from the columns 95.

With this configuration, the columns 95 can be reliably moved by the guide of the guide surface 96 of the process cartridge 115. Thus, the LED array head 14 can be reliably moved in association with the attachment or detachment of the process cartridge 115 with a simple configuration.

Next, an LED printer according to a third illustrative aspect will be described with reference to FIGS. 7 and 8. The following description focuses on points of the construction according to the third illustrative aspect that differ from the construction according to the second illustrative aspect.

Figure 7:
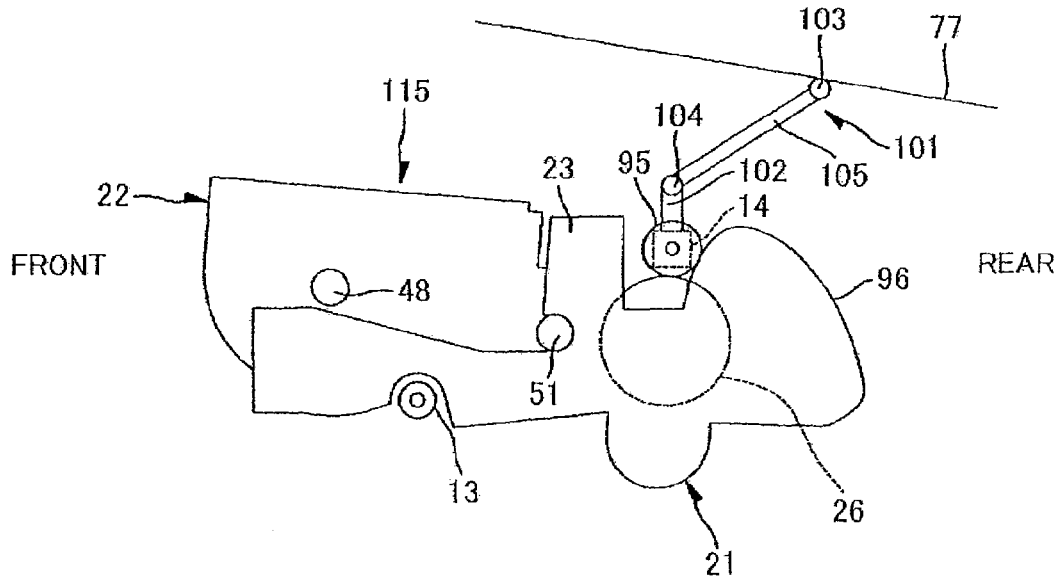
FIG. 7 is a side view illustrating a head moving mechanism according to a third illustrative aspect of the invention where an LED array head is located close vicinity to a photosensitive drum.
Figure 8:
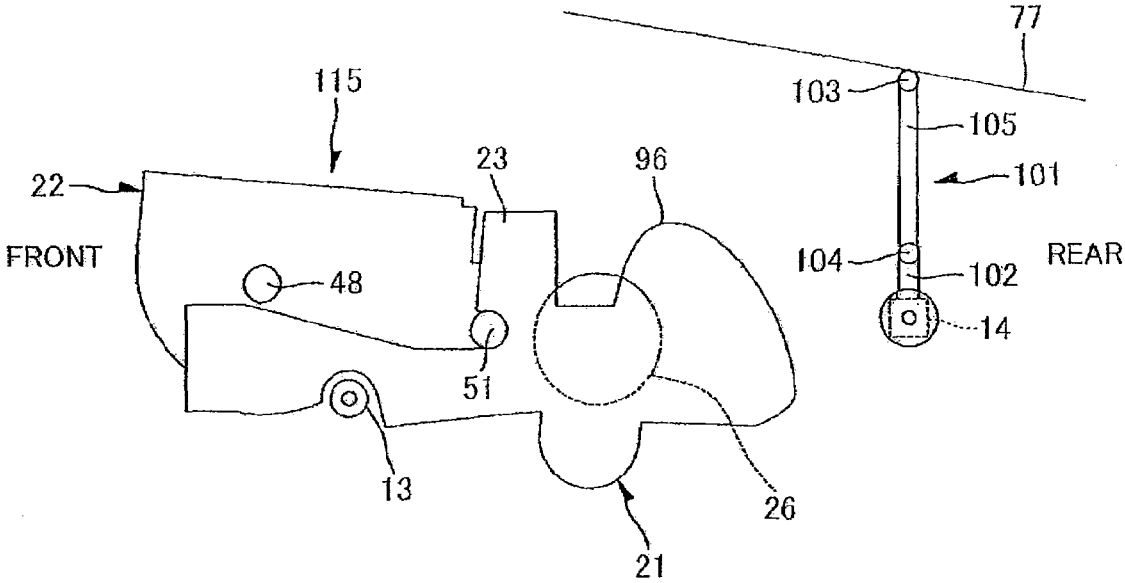
FIG. 8 is a side view illustrating the head moving mechanism in FIG. 7 where the LED array head is separated away from the photosensitive drum

The LED printer according to the third illustrative aspect includes a head moving mechanism 101 shown in FIGS. 7 and 8. The head moving mechanism 101 has a head holder 102, shafts 103 and 104, a head supporting arm 105, and a pair of columns 95. The LED array head 14 is connected to the lower end of the head holder 102. The shaft 103 extends in the widthwise direction along the upper wall 77 of the main casing 2, and the shaft 104 also extends in the widthwise direction. The upper end of the head supporting arm 105 is rotatably attached to the shaft 103, and the lower end thereof is inserted into the upper end of the head holder 102 and rotatably attached to the shaft 104. Thus, the head supporting arm 105 is pivotable about the shaft 103 with respect to the upper wall 77, and the head holder 102 is is pivotable about the shaft 104 with respect to the head supporting arm 105. The columns 95 are rotatably disposed on both sides of the LED array head 14 in the widthwise direction In the state where the process cartridge 115 is detached from the main casing 2, the LED array head 14 is located on the attachment/detachment path 83 When the process cartridge 115 is moved rearward toward the attachment position along the attachment/detachment path 83 for attachment, the rear portion of the guide surface 96 of the process cartridge 115 comes into contact with the columns 95.

When the process cartridge 115 is further moved rearward, the columns 95 roll over the rear portion of the guide surface 96. This causes the head supporting arm 105 to pivot about the shafts 103 and 104, moving the LED array head 14 and the head holder 102 upward against gravity.

When the process cartridge 115 is further moved rearward, the columns 95 pass the top of the guide surface 96, and the columns 95 roll over the front portion of the guide surface 96 downward. Thus, the LED array head 14 and the head holder 102 move downward. As shown in FIG. 7, when the process cartridge 115 has reached the attachment position, the columns 95 come into contact with the both widthwise ends of the photosensitive drum 26, and the LED array head 14 is disposed in close vicinity of the photosensitive drum 26 with a certain distance therebetween so as to be opposed to the photosensitive drum 26.

On the other hand, when the process cartridge 115 is moved forward from the state shown in FIG. 7, the columns 95 roll over the front portion of the guide surface 96 upward. Thus, the LED array head 14 and the head holder 102 move upward against gravity, and the LED array head 14 moves away from the photosensitive drum 26. When the process cartridge 115 is further moved forward, the columns 95 pass the top of the guide surface 96 and roll over the rear portion of the guide surface 96 downward. Thus, the LED array head 14 and the head holder 92 move downward. Then, the guide surface 96 separates from the columns 95 as shown in FIG. 8.

With this configuration also, the columns 95 can be reliably moved by the guide of the guide surface 96 of the process cartridge 115. Thus, the LED array head 14 can be reliably moved in association with the attachment or detachment of the process cartridge 115 with a simple configuration.

While the invention has been described in detail with reference to the above aspects thereof, it would be apparent to those skilled in the art that various changes and modifications may be made therein without departing from the spirit of the invention.

What is claimed is:

1. An image forming device comprising:

a main casing having an upper side and a first side other than the upper side, the main casing being formed with an opening in the first side;

a process cartridge including an image bearing member, the process cartridge being detachably attachable to the main casing through the opening;

a cover provided to the first side of the main casing, the cover being selectively opened and closed;

an LED array head disposed in the main casing, the LED array head irradiating a light on the image bearing member;

a head moving mechanism that moves the LED array head toward or away from the image bearing member, independently of the opening and the closing of the cover, as the process cartridge is attached to or detached from the main casing, the head moving mechanism comprising:

a contact member movable between a first position and a second position, wherein the contact member in the first position contacts the process cartridge in the state where the process cartridge is attached to the main casing, and the contact member in the second position is away from the process cartridge;

a connecting member that is connected to the LED array head: and a linking mechanism that moves the LED array head in association with the movement of the contact member, wherein the linking mechanism comprises:

a first rack gear formed at the contact member, a pinion gear engaging with the first rack gear; and a second rack gear formed at the connecting member and engaging with the pinion gear.

2. The image forming device according to claim 1, wherein the main casing has a second side that opposes the first side in a first direction parallel to the horizontal direction, and the image bearing member is disposed closer to the second side than a center of the process cartridge in the first direction in the state where the process cartridge is attached to the main casing.

3. The image forming device according to claim 1, wherein the process cartridge includes a guide member that contacts the contact member during attachment or detachment of the process cartridge to or from the main casing so as to guide the contact member to the first position or the second position.

* * * * *